US009145657B2

(12) United States Patent
Lee

(10) Patent No.: US 9,145,657 B2
(45) Date of Patent: Sep. 29, 2015

(54) SYSTEM FOR CONTROLLING LAND LEVELING WORK WHICH USES AN EXCAVATOR

(75) Inventor: Chun-Han Lee, Gimhae-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/347,545

(22) PCT Filed: Oct. 5, 2011

(86) PCT No.: PCT/KR2011/007341

§ 371 (c)(1),
(2), (4) Date: Mar. 26, 2014

(87) PCT Pub. No.: WO2013/051737

PCT Pub. Date: Apr. 11, 2013

(65) Prior Publication Data

US 2014/0244118 A1 Aug. 28, 2014

(51) Int. Cl.

| | |
|---|---|
| ***E02F 9/20*** | (2006.01) |
| ***E02F 3/43*** | (2006.01) |
| ***E02F 9/22*** | (2006.01) |

(52) U.S. Cl.

CPC ..... *E02F 9/2029* (2013.01); *E02F 3/437* (2013.01); *E02F 9/2228* (2013.01); *E02F 9/2296* (2013.01)

(58) Field of Classification Search

CPC ..... E02F 9/20; E02F 9/22; E02F 3/3681; E02F 9/2271; E02F 3/438; E02F 3/965; F16H 1/28

USPC ..... 701/50; 37/417; 700/11; 403/164

See application file for complete search history.

(56) References Cited

U.S. PATENT DOCUMENTS

| | | | |
|---|---|---|---|
| 4,889,466 | A | 12/1989 | Jindai et al. |
| 5,424,623 | A | 6/1995 | Allen et al. |

(Continued)

FOREIGN PATENT DOCUMENTS

| | | | |
|---|---|---|---|
| JP | 06-063249 | B2 | 8/1994 |
| JP | 2000-008400 | A | 1/2000 |

(Continued)

OTHER PUBLICATIONS

International Search Report (in Korean and English) and Written Opinion (in Korean) for PCT/KR2011/007341, mailed Apr. 23, 2012; ISA/KR.

(Continued)

*Primary Examiner* — McDieunel Marc

(74) *Attorney, Agent, or Firm* — Harness, Dickey & Pierce, P.L.C.

(57) ABSTRACT

A grading control system using an excavator is disclosed, which determines and controls an operation amount of an attachment by combining an estimated pose of the attachment and an operator's operation signal of a joystick when a working mode for grading the ground is selected. The grading control system using an excavator includes an actuator connected to a hydraulic pump, an attachment driven by the actuator, a control valve shifted to drive the actuator, an electric joystick, a pressure detection means, a means for setting a working mode, and a controller, and repeatedly performs receiving a joystick operation signal value, a pressure value of an arm cylinder, and information on whether to set the working mode, calculating an external force that is applied to the attachment by the pressure value generated in the arm cylinder if a grading mode is selected, estimating a pose of the arm by the calculated external force value, performing a signal process by filtering the pose of the arm, and calculating operation amounts of a boom and the arm by combining the estimated pose of the arm and a control signal value according to an operator's operation of the joystick and proceeding to an initial stage.

7 Claims, 2 Drawing Sheets

(56) References Cited

U.S. PATENT DOCUMENTS

| | | | | |
|---|---|---|---|---|
| 7,942,208 | B2 * | 5/2011 | Hughes et al. | 172/4.5 |
| 7,946,063 | B2 * | 5/2011 | Paull | 37/407 |
| 8,191,290 | B2 * | 6/2012 | Hughes et al. | 37/348 |
| 8,453,441 | B2 * | 6/2013 | Williamson et al. | 60/446 |
| 8,474,254 | B2 * | 7/2013 | Hughes et al. | 60/445 |
| 8,621,770 | B1 * | 1/2014 | McDonald | 37/417 |
| 8,639,416 | B2 * | 1/2014 | Jones et al. | 701/41 |
| 2012/0260642 | A1 * | 10/2012 | Opdenbosch et al. | 60/327 |
| 2013/0090771 | A1 | 4/2013 | Kim et al. | |
| 2013/0116897 | A1 | 5/2013 | Lee et al. | |
| 2013/0158679 | A1 * | 6/2013 | Oh et al. | 700/11 |
| 2013/0282187 | A1 * | 10/2013 | Bang | 700/282 |
| 2014/0007962 | A1 * | 1/2014 | Wang et al. | 137/565.29 |

FOREIGN PATENT DOCUMENTS

| | | | |
|---|---|---|---|
| JP | 03-453142 | B2 | 7/2003 |
| KR | 10-1996-0013596 | B1 | 10/1996 |

OTHER PUBLICATIONS

International Preliminary Report on Patentability (Chapter II) (in Korean) for PCT/KR2011/007341, dated Jan. 13, 2014; IPEA/KR.

* cited by examiner

Fig. 3]
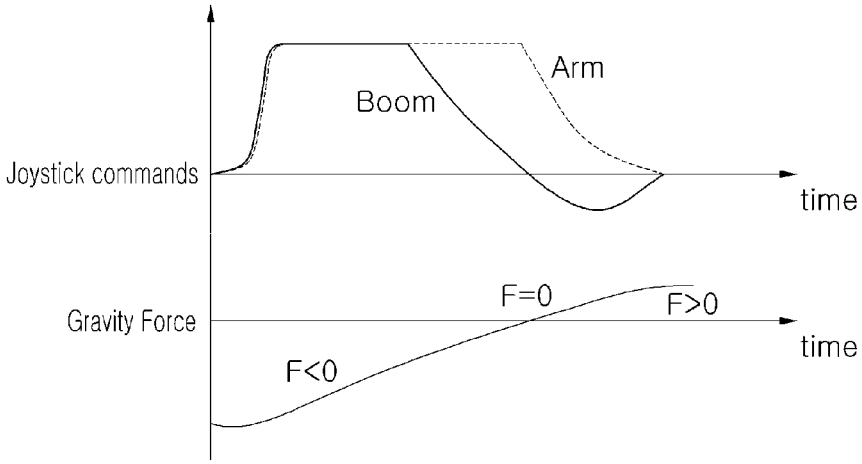
Fig. 4
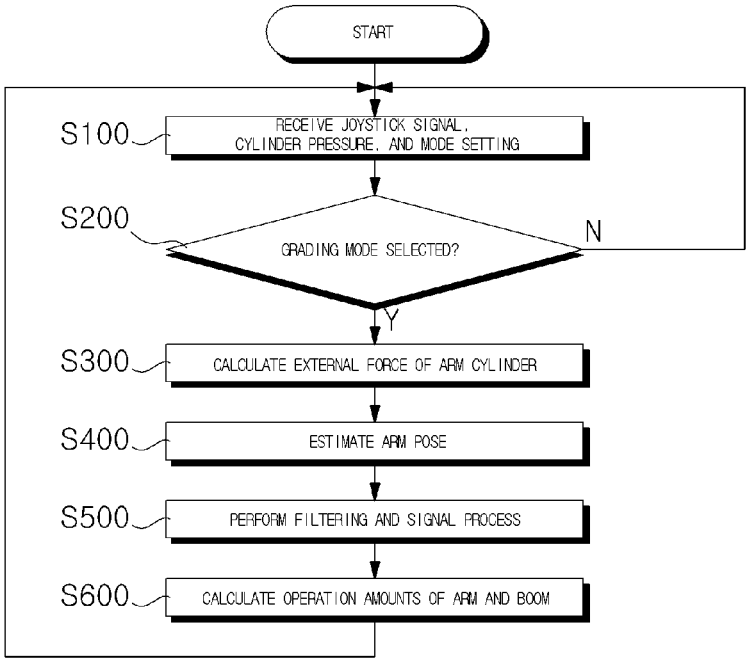

SYSTEM FOR CONTROLLING LAND LEVELING WORK WHICH USES AN EXCAVATOR

TECHNICAL FIELD

The present invention relates to a grading control system using an excavator. More particularly, the present invention relates to a grading control system using an excavator, which can determine and control an operation amount of an attachment (a boom or an arm) by combining an estimated pose of the attachment and an operator's operation signal of a joystick when a grading work for grading the ground is performed by operating a boom operation lever and an arm operation lever.

BACKGROUND ART

In general, in the case of performing a grading work using an excavator, it is required for a skilled operator having a long operating experience to perform an appropriate operation to linearly control the trace of a bucket end due to a complicated link structure of an attachment, such as a boom or an arm. In order to smoothly perform such an operation, automation technology to control the track using an angle sensor for measuring the pose of the attachment or a cylinder displacement sensor has been attempted.

Such automated grading work requires high costs, and during the automated grading operation, the operation of the attachment is limited to a set speed regardless of an operator's operation amount of the attachment. Further, if an operator simultaneously performs another type of work, it is necessary to repeatedly change the automated function setting and automated function release every time, and thus the operator's work fatigue is increased and the work efficiency is lowered.

DISCLOSURE

Technical Problem

Therefore, the present invention has been made to solve the above-mentioned problems occurring in the related art, and one embodiment of the present invention is related to a grading control system using an excavator, which enables an unskilled person to smoothly perform a grading work for grading the ground and enables a skilled person to reduce fatigue due to repeated grading work to improve work efficiency.

Technical Solution

In accordance with an aspect of the present invention, there is provided a grading control system using an excavator including a variable displacement hydraulic pump, at least one hydraulic actuator connected to the hydraulic pump, an attachment including a boom and an arm driven by the actuator, a control valve installed in a flow path between the hydraulic pump and the actuator and shifted to drive the actuator, at least one electric joystick, a pressure detection means for detecting pressure generated in the actuator, a means for setting a working mode, and a controller outputting a control signal for shifting the control valve, the grading control system repeatedly performing receiving a control signal value through an operation of the joystick, a pressure value of an arm cylinder detected by the pressure detection means, and information on whether to set the working mode; calculating an external force that is applied to the attachment by the pressure value generated in the arm cylinder if a grading mode is set; estimating a pose of the arm by the calculated external force value; performing a signal process through filtering of the pose of the arm; and calculating operation amounts of the boom and the arm by combining the estimated pose of the arm and the control signal value according to an operator's operation of the joystick, and proceeding to an initial stage.

Preferably, a pressure sensor that detects the pressure generated in the arm cylinder and transmits a detected signal to the controller is used as the pressure detection means.

A pressure switch that is turned on/off when the pressure on a supply side of the arm cylinder reaches a preset pressure and generates a signal may be used as the pressure detection means.

A switch that is provided on the joystick may be used as the means for setting the working mode.

A switch that is provided in a cab may be used as the means for setting the working mode.

A monitor that is provided in a cab may be used as the means for setting the working mode.

Advantageous Effect

The grading control system using an excavator as configured above according to the aspects of the present invention as configured above has the following advantages.

When the grading mode is selected to perform the grading work for grading the ground using the excavator, the operation of the boom and the arm is controlled by combining the estimated pose of the attachment and the operator's operation signal of the joystick, and thus the grading operation is simplified. Accordingly, fatigue due to the repeated grading work can be reduced, and workability can be improved.

BRIEF DESCRIPTION OF THE DRAWINGS

The above objects, other features and advantages of the present invention will become more apparent by describing the preferred embodiments thereof with reference to the accompanying drawings, in which:

FIG. 3 is a diagram illustrating the correlation between an operator's operation of a joystick and gravity that acts on an arm cylinder during a grading work in a grading control system using an excavator according to an embodiment of the present invention; and FIG. 4 is a flowchart illustrating the operation of a grading control system using an excavator according to an embodiment of the present invention.

DESCRIPTION OF REFERENCE NUMERALS IN THE DRAWING

Figure 1:
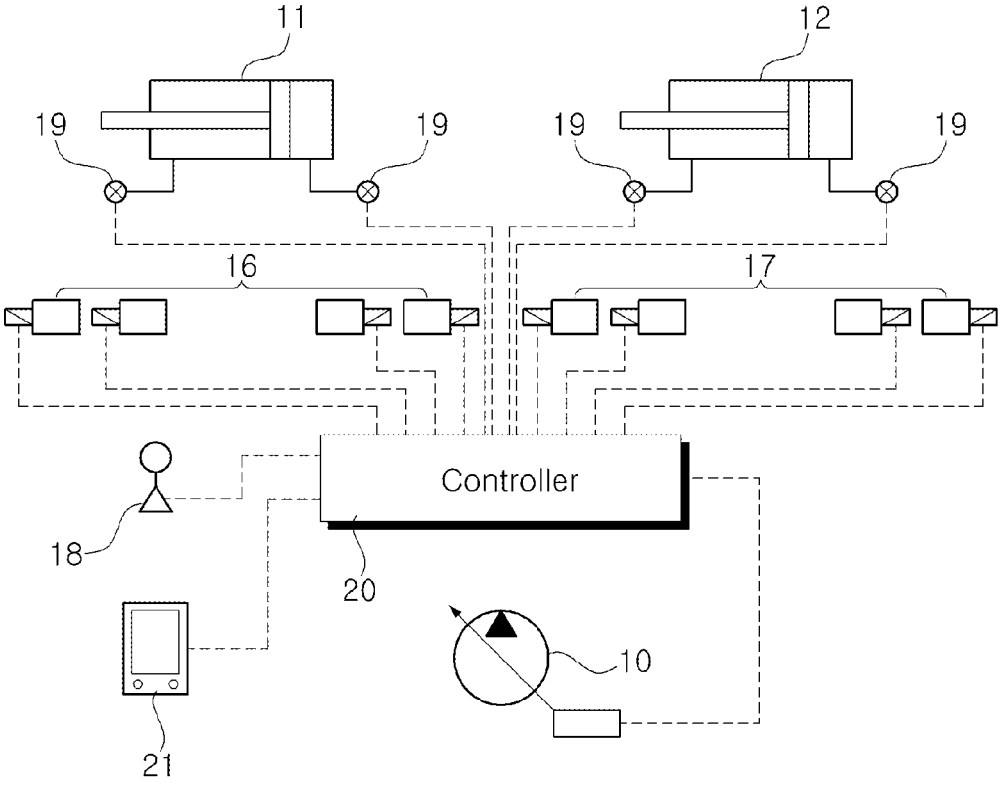
FIG. 1 is a diagram illustrating an electrical configuration of a grading control system using an excavator according to an embodiment of the present invention.

10: variable displacement hydraulic pump
11, 12: hydraulic cylinder
13: boom
14: arm
15: attachment
16, 17: control valve
18: joystick
19: pressure detection means
20: controller
21: monitor

BEST MODE

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

According to an embodiment of the present invention as illustrated in FIGS. 1 to 4, a grading control system using an excavator includes a variable displacement hydraulic pump (hereinafter referred to as a "hydraulic pump") 10, at least one hydraulic actuator (as an example, hydraulic cylinder) 11 and 12 connected to the hydraulic pump 10, an attachment 15 including a boom 13 and an arm 14 driven by the actuator 11 and 12, a control valve 16 and 17 installed in a flow path between the hydraulic pump 10 and the actuator 11 and 12 and shifted to drive the actuator 11 and 12, at least one electric joystick 18 outputting an electric control signal corresponding to an operator's operation amount, a pressure detection means 19 for detecting pressure generated in the actuator 11 and 12, a means for setting a working mode, and a controller 20 outputting a control signal for shifting the control valve 16 and 17, the grading control system repeatedly performing receiving a control signal value through an operation of the joystick 18, a pressure value of the arm cylinder 11 detected by the pressure detection means 19, and information on whether to set the working mode (S100); determining whether a grading mode is set (S200); calculating an external force that is applied to the attachment 15 by the pressure value generated in the arm cylinder 11 if the grading mode is set (S300); estimating a pose of the arm 14 by the calculated external force value (S400); performing a signal process through filtering of the pose of the arm 14 (S500); and calculating operation amounts of the boom 13 and the arm 14 by combining the estimated pose of the arm 14 and the control signal value according to an operator's operation of the joystick 18, and proceeding to an initial stage (S100) (S600).

In this case, a pressure sensor that detects the pressure generated in the arm cylinder 11 and transmits a detected signal to the controller 20 is used as the pressure detection means 19.

A pressure switch that is turned on/off when the pressure on a supply side of the arm cylinder 11 reaches a preset pressure and generates a signal is used as the pressure detection means 19.

A switch that is provided on the joystick 18 is used as the means for setting the working mode.

A switch that is provided in a cab (not illustrated) is used as the means for setting the working mode.

A monitor 21 that is provided in the cab (not illustrated) is used as the means for setting the working mode.

Hereinafter, a use example of the grading control system using an excavator according to an embodiment of the present invention will be described in detail.

As illustrated in FIGS. 1 to 4, as the joystick 18 is operated to drive the hydraulic cylinder 11 and 12, the control valve 16 and 17 is shifted by the electrical control signal from the controller 20. Through this, hydraulic fluid that is discharged from the hydraulic pump 10 is supplied to the hydraulic cylinder 11 and 12 through the control valve 16 and 17, and at the same time, the hydraulic fluid that returns from the hydraulic cylinder 11 and 12 drains to a hydraulic tank (not illustrated), and the hydraulic cylinder 11 and 12 is extended and contracted.

In this case, the detected signal for the pressure that is generated in the hydraulic cylinder 11 and 12 detected by the pressure detection means 19 is transmitted to the controller.

Figure 2:
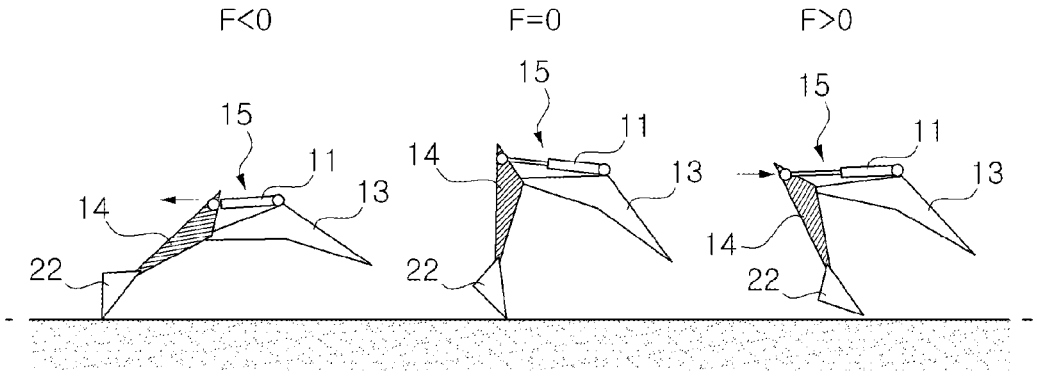
FIG. 2 is a view illustrating the level and direction of gravity that acts on an arm cylinder during a grading work in a grading control system using an excavator according to an embodiment of the present invention.

Hereinafter, a grading process using an excavator according to an embodiment of the present invention will be described with reference to FIGS. 2 to 4.

As in S100, the control signal value through an operation of the joystick 18, the pressure value of the arm cylinder 11 detected by the pressure detection means 19, and information on whether to set the working mode are received.

As in S200, whether a grading mode is set is determined, and if the grading mode is set, the process proceeds to S300, while if the grading mode is not set, the process proceeds to an initial stage.

As in S300, the external force that is applied to the attachment (as an example, arm cylinder) 15 is calculated by the pressure value generated in the arm cylinder 11. In this case, the external force value P that is applied to the attachment 15 is calculated by the following equation.

$$P=(Pa\times Aa)-(Pb\times Ab)$$

Here, Pa and Pb denote pressures on the head side and the rod side of the arm cylinder 11 that are detected by the pressure detection means 19, and Aa and Ab denote effective cross-sectional areas on the head side and the rod side of the arm cylinder 11.

As in S400, the pose of the arm 14 is estimated by the calculated external force value P. As shown in FIG. 2, the pose of the arm 14 during the grading work is estimated on the assumption that the external force of the arm cylinder 11 is a force that acts by a gravity force (called "F"). That is, if the gravity force F is lower than "0" (F<0), the external force is not applied to the arm cylinder 11 that is in an arm-out driving state, and the front end of the arm 14 is maximally far apart from the boom 13. If the gravity force F is "0" (F=0), the arm cylinder 11 is extended, and the front end of the arm 14 is kept in the vertical direction. If the gravity force F is higher than "0" (F>0), the external force is applied to the arm cylinder 11 that is in an arm-in driving state, and the front end of the arm 14 is maximally close to the boom 13.

As shown in FIG. 3, the operation amounts of the boom 13 and the arm 14 and the speed command value are correlated to each other according to the pose of the arm during the grading work.

If the gravity force F that acts on the arm cylinder 11 is lower than "0" (F<0), the boom 13 and the arm 14 are driven in proportion to the boom and arm joystick operation amounts. If the gravity force F that acts on the arm cylinder 11 is "0" (F=0), the boom joystick is in a stop state, and the arm joystick is in a full operation state. If the gravity force F that acts on the arm cylinder 11 is higher than "0" (F>0), the arm joystick operation amount is reduced.

As in S500, the pose of the arm 14 is filtered to perform the signal process.

As in S600, the operation amounts of the boom 13 and the arm 14 are calculated by combining the estimated pose of the arm 14 and the control signal value according to an operator's operation of the joystick 18, and the process proceeds to the initial stage (S100). The above-described processes are repeated. In this case, the operation amounts of the arm 14 and the boom 13 are defined according to predefined table values based on the estimated pose of the arm 14 and the operation signal of the joystick 18.

As described above, if the grading mode for grading the ground is selected and the arm is driven by the operator's operation of the arm operation lever, the pose of the arm 14 is estimated using the pressure that is detected in the hydraulic cylinder 11 by the pressure detection means 19, and based on this, the operation amounts of the boom 13 and the arm 14 are compensated for or determined. Accordingly, the operator can easily perform the grading work through linear control of the trace of the end of the bucket 22 with a simple operation.

Industrial Applicability

As apparent from the above description, according to the grading control system using an excavator according to an embodiment of the present invention, When the grading mode is selected to perform the grading work for grading the ground using the excavator, the operation of the attachment is controlled by combining the estimated pose of the attachment and the operator's operation signal of the joystick during the grading work for grading the ground using the excavator, and thus the grading operation can be easily performed while securing the operator's operability according to the joystick operation. Through this, convenience can be provided to the unskilled person, and the skilled person's fatigue due to the repeated grading work can be reduced to improve the workability.

The invention claimed is:

1. A grading control system for an excavator comprising:

a variable displacement hydraulic pump, at least one hydraulic actuator connected to the hydraulic pump, an attachment including a boom and an arm driven by the actuator, a control valve installed in a flow path between the hydraulic pump and the actuator and shifted to drive the actuator, at least one electric joystick, a pressure detection means for detecting pressure generated in the actuator, a means for setting a working mode, and a controller outputting a control signal for shifting the control valve;

wherein the grading control system is configured to repeatedly perform the following:

receiving a control signal value through an operation of the joystick, a pressure value of an arm cylinder detected by the pressure detection means, and information on whether to set the working mode, the pressure detection means including at least one pressure sensor that detects a hydraulic pressure generated in the head side and the rod side of the arm cylinder and transmits a detected signal of the hydraulic pressure to the controller;

calculating, by the controller, an external force that is applied to the attachment by the pressure value generated in the arm cylinder if a grading mode is set;

estimating whether a pose of the arm cylinder is in an arm-in driving state or in an arm-out driving state, depending on the calculated external force value;

performing a signal process of the control valve through filtering of the pose of the arm; and calculating, by the controller, operation amounts of the boom and the arm by combining the estimated pose of the arm and the control signal value according to an operator's operation of the joystick, the operation amounts of the arm and the boom are determined according to predefined table values based on the estimated pose of the arm and the control signal value of the joystick, and proceeding to an initial stage.

2. The grading control system using an excavator according to claim 1, wherein a pressure switch that is turned on/off when the pressure on a supply side of the arm cylinder reaches a preset pressure and generates a signal is used as the pressure detection means.

3. The grading control system using an excavator according to claim 1, wherein a switch that is provided on the joystick is used as the means for setting the working mode.

4. The grading control system using an excavator according to claim 1, wherein a switch that is provided in a cab is used as the means for setting the working mode.

5. The grading control system using an excavator according to claim 1, wherein a monitor that is provided in a cab is used as the means for setting the working mode.

6. A grading control system for an excavator comprising:

a variable displacement hydraulic pump;

a hydraulic actuator connected to the hydraulic pump, the hydraulic actuator including an arm cylinder having a head side and a rod side;

an excavator attachment including a boom and an arm driven by the hydraulic actuator;

a control valve installed in a flow path between the hydraulic pump and the hydraulic actuator and shifted to drive the hydraulic actuator;

at least one electric joystick;

a pressure detector configured to detect pressure generated in the hydraulic actuator, the pressure detector including at least one pressure sensor that detects a hydraulic pressure generated in the head side and the rod side of the arm cylinder;

a controller configured to:

output a control signal for shifting the control valve, and receive a control signal value through operation of the joystick;

receive a pressure value of the arm cylinder detected by the pressure sensor, the pressure value including the hydraulic pressure generated in the head side and the rod side of the arm cylinder;

calculate a magnitude of the gravitational force applied to the attachment based on the pressure value;

estimate whether a pose of the arm cylinder is in an arm-in driving state or an arm-out driving state based on the calculated magnitude of gravitational force applied to the attachment; and calculate operation amounts of the boom and the arm by combining the estimated pose of the arm and control signal value according to an operator's operation of the joystick, the operation amounts of the arm and the boom are determined according to predefined table values based on the estimated pose of the arm and the control signal value of the joystick.

7. A method for controlling an attachment of an excavator during a land leveling operation comprising:

calculating magnitude of gravitational force applied to the attachment based on a pressure value of an arm cylinder of the excavator detected by a pressure sensor, the pressure value including hydraulic pressure generated in a head side and a rod side of the arm cylinder, the arm cylinder included with a hydraulic actuator connected to a hydraulic pump of the excavator;

estimation whether a pose of the arm cylinder is in an arm-in driving state or an arm-out driving state based on the calculated magnitude of gravitational force applied to the attachment; and calculating operation amounts of a boom and an arm of the attachment by combining the estimated pose of the arm and the control signal value generated according to an operator's operation of the joystick, the operation amounts of the arm and the boom are determined according to predefined table values based on the estimated pose of the arm and the control signal value of the joystick.

* * * * *